US010082025B2

(12) United States Patent
MacDonald

(10) Patent No.: US 10,082,025 B2
(45) Date of Patent: Sep. 25, 2018

(54) SYSTEM FOR THE REDUCTION IN APPLIED ENERGY, IMPROVED EFFICIENCIES AND REDUCED COSTS IN OPEN PIT MINING

(71) Applicant: Emergent Mining Technologies Pty Ltd, Brisbane (AU)

(72) Inventor: Brian MacDonald, Brookfield (AU)

(73) Assignee: Emergent Mining Technologies Pty Ltd, Brisbane (AU)

( * ) Notice: Subject to any disclaimer, the term of this patent is extended or adjusted under 35 U.S.C. 154(b) by 152 days.

(21) Appl. No.: 14/632,678

(22) Filed: Feb. 26, 2015

(65) Prior Publication Data

US 2015/0252671 A1 Sep. 10, 2015

(30) Foreign Application Priority Data

Mar. 5, 2014 (AU) ..... 2014900733
Jan. 22, 2015 (AU) ..... 2015200304

(51) Int. Cl.
*E21C 41/26* (2006.01)

(52) U.S. Cl.
CPC ..... *E21C 41/26* (2013.01)

(58) Field of Classification Search
CPC ..... E21C 41/31; E21C 41/30; E21C 41/28; E21C 41/26; E21C 41/14; E21C 41/04; E21C 41/00; E21C 41/10
USPC ..... 299/18, 19
See application file for complete search history.

(56) References Cited

U.S. PATENT DOCUMENTS 1,980,634 A * 11/1934 Philips ..... E02D 17/18 37/195
2,040,022 A * 5/1936 Philips ..... E02B 3/06 405/117
3,799,613 A * 3/1974 Hendry ..... E21C 41/31 299/18
4,150,852 A * 4/1979 McCoy ..... E21C 41/28 299/18

(Continued)

FOREIGN PATENT DOCUMENTS

AU 709808 9/1999
CN 1601054 3/2005

(Continued)

OTHER PUBLICATIONS

Office Action dated Jul. 6, 2016, issued in corresponding CA App. No. 2,883,015.

(Continued)

*Primary Examiner* — Sunil Singh
(74) *Attorney, Agent, or Firm* — Boyle Fredrickson S.C.

(57) ABSTRACT

The present invention relates to an open pit mining system. The system includes a material lifting machine configured to both: (1) excavate and remove overburden from an open pit of a mine; and (2) excavate and remove valuable material from the open pit. Advantageously, the machine removes the overburden waste material as well as the mined valuable material which would otherwise be conventionally removed by trucks in the pit, out of the pit up the ramps and then onto the processing plant. Accordingly, the use of trucks for transporting valuable material both along and up out of the pit is at least to some extent reduced thereby resulting in improved cost and energy efficiency.

18 Claims, 13 Drawing Sheets

(56) References Cited

U.S. PATENT DOCUMENTS

| | | | | |
|---|---|---|---|---|
| 4,150,853 | A | 4/1979 | McCoy | |
| 4,234,073 | A * | 11/1980 | Satterwhite | B65G 39/145 198/304 |
| 4,261,119 | A | 4/1981 | Kubo et al. | |
| 4,290,651 | A * | 9/1981 | Files | E21C 41/26 299/18 |
| 4,453,770 | A * | 6/1984 | Dalrymple | E21C 41/32 299/18 |
| 4,466,669 | A | 8/1984 | Sellers | |
| 4,589,700 | A | 5/1986 | Shroder | |
| 5,194,689 | A | 3/1993 | Cummins | |
| 5,404,988 | A | 4/1995 | Konigs | |
| 5,409,298 | A * | 4/1995 | Dickerson | E02F 3/52 299/19 |
| 5,410,826 | A * | 5/1995 | Immel | E02F 9/2833 37/455 |
| 5,636,903 | A | 6/1997 | Dickerson et al. | |
| 2009/0099708 | A1* | 4/2009 | Greiner | G07C 5/008 701/1 |
| 2011/0253502 | A1 | 10/2011 | Neilson et al. | |
| 2011/0254345 | A1 | 10/2011 | Neilson et al. | |
| 2013/0206548 | A1 | 8/2013 | Brewka et al. | |

FOREIGN PATENT DOCUMENTS

| | | |
|---|---|---|
| GB | 2055926 | 3/1981 |
| SU | 1411471 A * | 7/1989 |
| WO | 2003044322 | 5/2003 |

OTHER PUBLICATIONS

AU Exam Report No. 1, dated Apr. 17, 2015, in corresponding AU App. 2015100065.
AU Exam Report No. 1, dated Apr. 17, 2015, in corresponding AU App. 2015100066.
AU Exam Report No. 1, dated Apr. 17, 2015, in corresponding AU App. 2015100067.
AU Exam Report No. 1, dated Jun. 30, 2014, in corresponding AU App. 2014100343.
AU Exam Report No. 2, dated Aug. 21, 2014, in corresponding AU App. 2014100343.

* cited by examiner

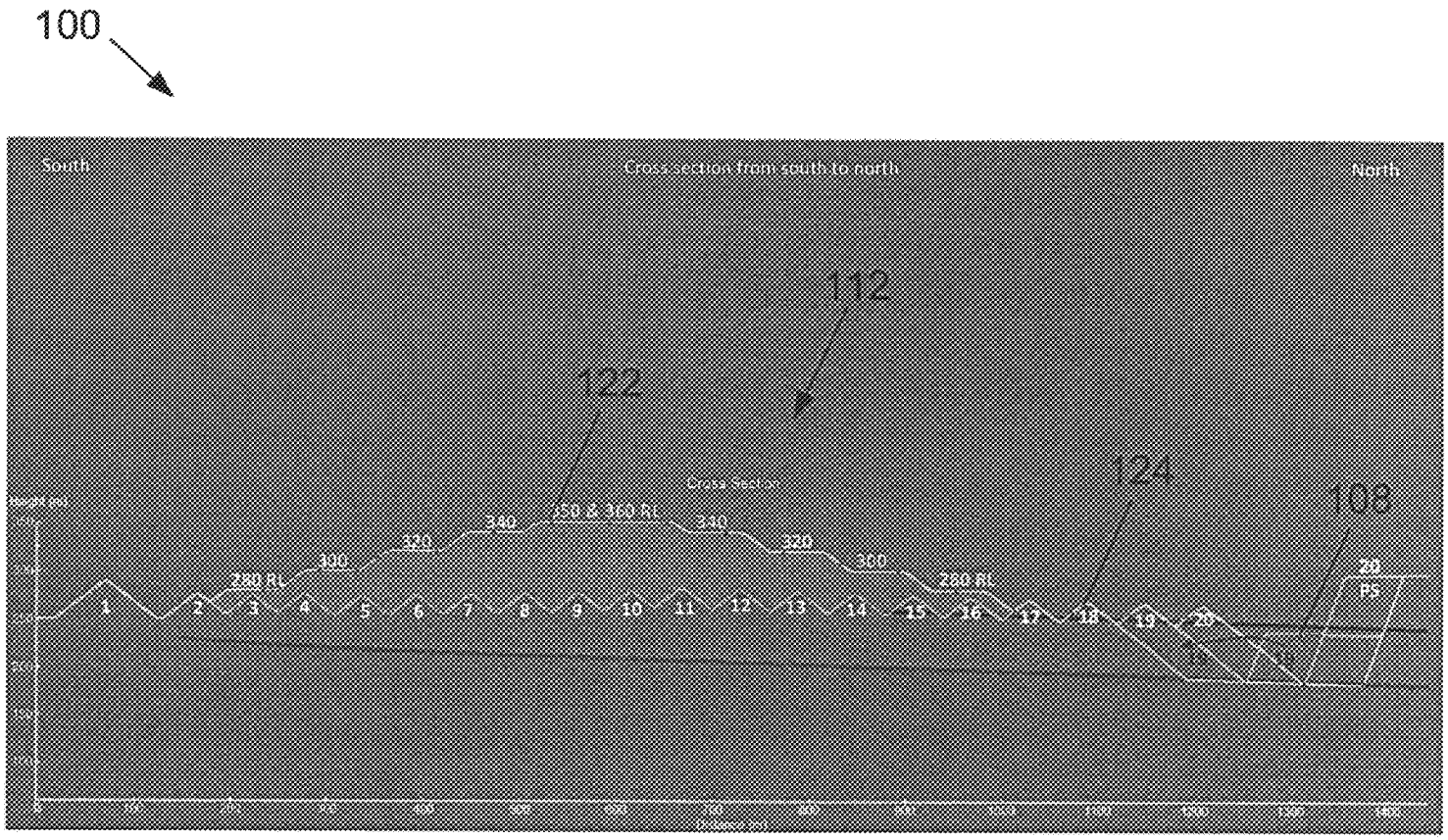
100
South
Cross section from south to north
North
112
122
124
102
Cross section
Depth m
Depth m
Depth m

SYSTEM FOR THE REDUCTION IN APPLIED ENERGY, IMPROVED EFFICIENCIES AND REDUCED COSTS IN OPEN PIT MINING

TECHNICAL FIELD

The present invention generally relates to open pit mining.

BACKGROUND

The reference to any prior art in this specification is not, and should not be taken as an acknowledgement or any form of suggestion that the prior art forms part of the common general knowledge.

Open pit mining is a common method for extracting valuable material such as coal.

Turning to FIG. 1, a typical open pit coal mining system 100 includes blasted waste overburden 102 upon which a dragline 104 is located. The dragline 104 lifts and removes the overburden 102 forming a moving strip mine highwall 106 of an open pit 108 to expose a coal seam 110 in the mine pit 108. The dragline 104 piles the overburden 102 in parallel rows, colloquially termed low wall spoil 112, as the dragline 104 moves along forming the pit 108. This sequence is typical of an overall mining system termed a strip mine. However, embodiments of the present invention equally apply to a non-strip mining systems.

An excavator (or front end loader or face shovel) 114 is located at the floor 116 of the pit 108. The excavator 114 excavates the coal 110 and loads it into pit haulage trucks 118 on the pit floor 116. The low speed trucks 118 are specialized off road vehicles specifically designed to cater for the often undulating and uneven nature of the pit floor 116 whilst accessing the excavator 114 loading area, and which also have high power engines and driveline systems which are capable of transporting the material up and out of the pit 108. The trucks 118 gain access to the pit 108 via specially constructed haulage access ramps 120 which are formed through the low wall spoil 112. The ramps 120 are specifically developed at a gradient that optimally permits the trucks to traverse up the ramp 120 with a full load of material, as well as returning empty down the ramp safely and specifically within the design limits of the trucks' braking systems. The ramps 120 are periodically created along the strip mine pit 108, which not only involves the removal and/or relocation of significant amounts of overburden waste material to form the ramps 120, but also involves the need to find a location to deposit that material away from the ramp area.

Upon loading, the trucks 118 exit the pit 108 via the ramps 120, making the often long and arduous journey up the ramps 120 to the top of the mine pit 108, and thence they transport the valuable material to the mineral processing plant which is typically located some distance away from the open pit.

FIGS. 1A and 1C clearly show the ramps 120 with a 60 meter wide strip mine pit 108. The overall dimensions of the exampled worked mining system 100 are 3,000 meter length and 1,200 meter width. As can best be seen in FIG. 1B, the low wall spoil 112 includes a pre-strip volume 122 piled high upon a dragline volume 124. After mining ceases, the low wall spoil 112 is levelled out to fill in the ramps 120 and rehabilitate the land.

In recent times, the value of coal and other minerals has dipped. The adverse economic burden placed on miners has resulted in the closure of existing mines and a deferment on the creation of new mines.

Embodiments of the present invention provide increased efficiencies and lower energy consumption, resulting in improved mining techniques and reduced costs in order to sustain mining profitability in view of falling mineral prices.

SUMMARY OF THE INVENTION

According to a first aspect of the present invention, there is provided an open pit mining system, the system including a material lifting machine configured to:

excavate and remove overburden from an open pit of a mine; and excavate and remove valuable material from the open pit.

The system further includes the pit having no valuable material haulage ramps. The machine may include a dragline, crawler, walking crane or any other like primary lifting tool which lifts the overburden separately from the valuable material. The system may not include any excavation equipment in the pit.

The system may further include excavation and haulage equipment for pre-stripping waste from the overburden. The system may further include a deposited stockpile of removed valuable material at about the elevation of the machine or alternatively on the adjacent highwall above the level of the machine. The system may further include haulage equipment for hauling the deposited valuable material. The system may further include one or more haulage bridges bridging the pit to assist with hauling pre-stripped waste.

The system may further include an overburden drilling equipment to drill when preparing for blasting. The system may further include a spoil reconditioning excavator for reconditioning land on a low wall side of the pit.

According to a second aspect of the present invention, there is provided an open pit mining method using one or more material lifting machines, the method including the step of the lifting machines:

excavating and removing overburden from an open pit of a mine; and excavating and removing valuable material from the open pit.

Advantageously, the machine that removes the overburden waste material may also remove the mined valuable material which would otherwise be conventionally removed by trucks in the pit, out of the pit up the ramps and thence onto the processing plant. Accordingly, the use of trucks for transporting valuable material both along and up out of the pit is at least to some extent reduced thereby resulting in improved cost and energy efficiency.

Additionally or alternatively, another machine that is primarily a lifting machine or lifting device (such as a crane or otherwise—including potentially a $2^{nd}$ dragline) is provided and removes the mined valuable material which would otherwise be conventionally removed by trucks in the pit, out of the pit up the ramps and thence onto the processing plant. Accordingly, the use of trucks for transporting valuable material both along and up out of the pit is at least to some extent reduced thereby resulting in improved cost and energy efficiency.

The method may not involve forming haulage access ramps to the pit. Advantageously, the need to create and later fill the access ramps is avoided thereby further increasing efficiency. The method may not involve providing equipment located in the pit to excavate the mined valuable material, or to build and maintain access roads to further increase efficiency. As such, rehabilitation of the ramp areas and access roads may be avoided, as the ramp areas and access roads may no longer exist, which in turn may improve the efficiency and reduce the cost of post mining landform rehabilitation activities.

The machine may include a dragline. The machine may include a crawler, walking crane or any other like primary lifting tool or device.

The method may involve depositing the removed valuable material at the elevation of the machine or alternatively on the adjacent highwall above the level of the machine. The height between removal and depositing of the valuable material may be in the range of 40 m to 60 m or otherwise applicable to the efficient operation of the overburden waste removal machine.

The method may further involve hauling away the deposited valuable material without the need to use specialized mining haulage trucks designed for use in the open pit and up the ramps. The method may further involve hauling away the deposited valuable material in specialized long distance hauling trucks, which may be of a multi-trailer configuration or otherwise which are capable of carrying larger loads of material at greater efficiencies over longer distances than the specialized off road haul trucks that may be required to haul material along the base of the pit and out of pit up the access ramps.

The method may alternatively further involve transporting away the deposited valuable material by means of conveyor or by means of a train, which may or may not be loaded by means of a loading device, overhead bin or hopper, or by other means. Such transportation to the processing plant by these means over the distance to the mineral processing plant is undertaken at a greater level of efficiency as compared to that of the specialized trucks that may be required to haul material along the base of the pit and out of pit up the access ramps.

The method may further include the step of pre-stripping waste overburden material. The step of pre-stripping may involve hauling waste over overburden bridges crossing the open pit, thus reducing the haulage distance required if the material was required to be hauled around the open pit or away from and in between access ramps. The method may involve creating a series of the bridges whose location is unaffected in the event of the absence of a pit ramp.

Preferably, there is no equipment in the open pit during the steps of removing so that the method may further involve blasting adjacent the open pit either during or prior to completion of steps of removing material from the open pit. Advantageously, blasting can occur whist material is still being removed from the mine which results in significant efficiency gains as well as reduced inventories of in pit stocks for drilled overburden waste material, drilled and blasted overburden waste material, and other inventories of materials required associated with same.

According to a third aspect of the present invention, there is provided an open pit mining system including:

a first lifting machine for excavating and removing overburden from an open pit of a mine; and a second lifting machine for excavating and removing valuable material from the open pit.

Advantageously, the two machines operating in tandem can result in improved cost and energy efficiency when compared to known mining techniques.

Preferably, the first lifting machine adds the removed overburden to a low wall. Even more preferably, the first lifting machine for part of its operation rests upon an in pit bench or shelf, in turn, upon which the low wall is formed.

Preferably, the second lifting machine places the removed valuable material on the high wall. Even more preferably, the second lifting machine rests upon the high wall.

Preferably, the open pit is a strip mine pit and the first lifting machine operates within the pit whereas the second machine operates at the side of the pit on the highwall. Preferably, the lifting machines operate simultaneously. Preferably, at least one of the lifting machines includes a mechanism to impede line interference with a pit edge of the highwall.

According to a fourth aspect of the present invention, there is provided an open pit strip mine including a strip mine pit not more than 40 meters wide. Preferably, the pit is about 30 meters wide.

Preferably, an overburden spoil pile is formed adjacent the strip mine pit, the spoil pile defining a plateau. Even more preferably, the plateau spans most of the length of the strip mine pit. Even more preferably, the plateau spans most of the width of the strip mine. Advantageously, the spoil pile may define a low plateau when compared with conventional strip mines thereby greatly reducing the cost and increasing the efficiency involved with rehabilitation after mining has ceased.

According to a fifth aspect of the present invention, there is provided an open pit mine including a mine pit with no haulage ramps.

Preferably, the mine pit is a strip mine pit and the low wall is continuous along the length of the strip mine pit. The mine may further include one or more bridges extending across the mine pit. There may be no personnel operating excavating equipment on a floor of the mine pit. The mine may further include high speed valuable material haulage trucks and no low speed pit haulage trucks.

Any of the features described herein can be combined in any combination with any one or more of the other features described herein within the scope of the invention.

BRIEF DESCRIPTION OF THE DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows:

FIG. 1B is an end sectional view of the mining system of FIG. 1A;

DETAILED DESCRIPTION OF PREFERRED EMBODIMENTS

Figure 2:
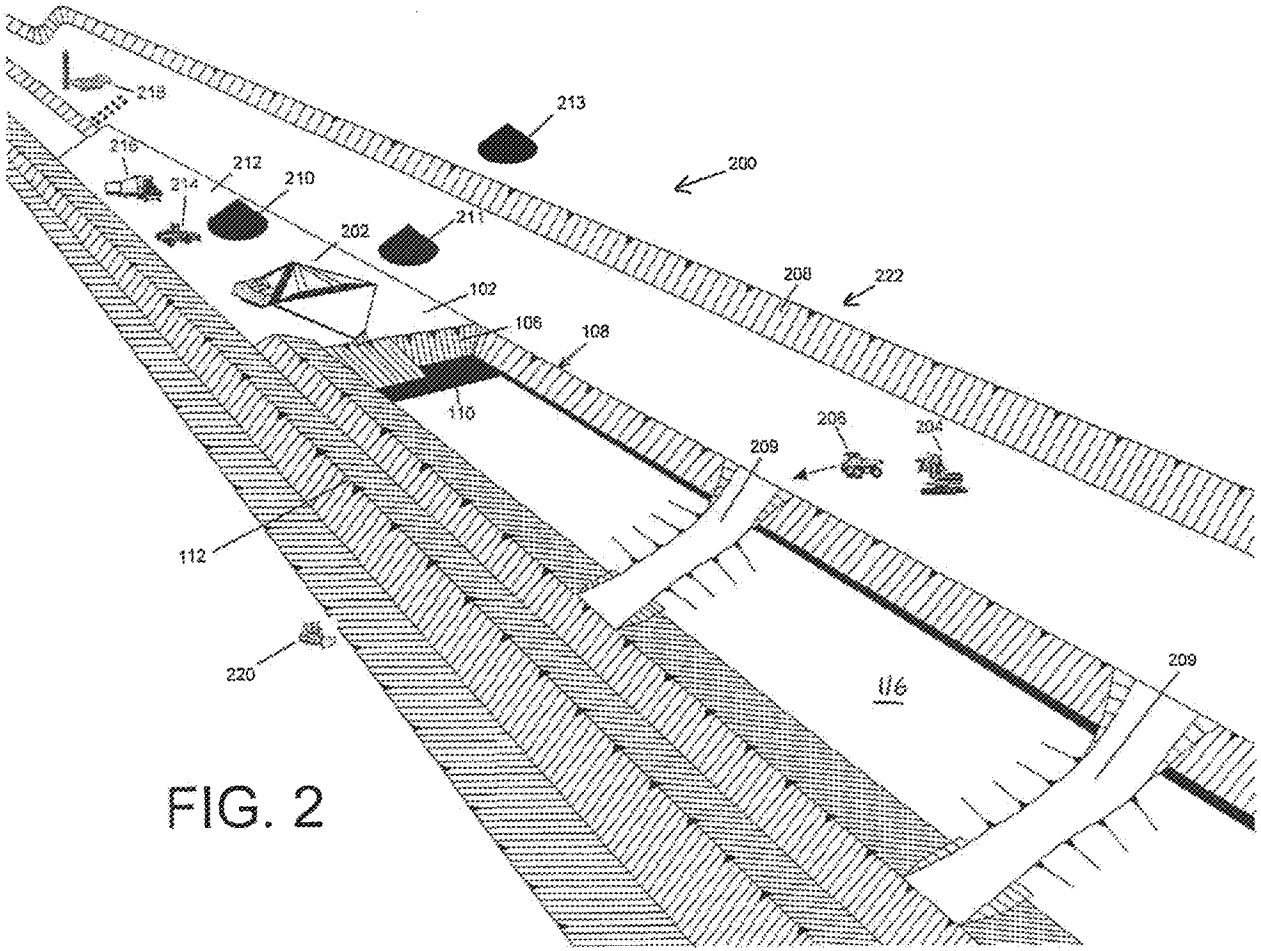
FIG. 2 is a schematic perspective diagram showing an open pit coal mining system in accordance with an embodiment of the present invention.

According to an embodiment of the present invention, there is provided an open pit strip mining system 200 as shown in FIG. 2. The system 200 includes a dragline 202 (i.e. material removing machine) which is otherwise both an excavating tool and a primary lifting tool, configured to remove overburden 102 from an open pit 108 of a mine. The dragline 202 may also remove coal 110 (i.e. valuable material) from the open pit 108.

Advantageously, the dragline 202 removes not only the waste overburden 102, but also mined coal 110 which would otherwise be conventionally removed by excavator and trucks 118 located in the open pit 108. Accordingly, the use of trucks 118 for transporting coal 110 both along and up out of the pit 108 is avoided thereby resulting in improved mining efficiency.

Additionally (or as an alternative to the dragline 202), the mined coal 110 may also be removed from the pit 108 by a primary lifting machine unrelated to the dragline 202, such as a crawling or walking crane, which may be modified in order to operate in the mode required to perform this function. Alternatively, there may also be a $2^{nd}$ dragline employed to remove the coal from the open pit, which may or may not also be specially configured to perform this function. Accordingly, the use of trucks 118 for transporting coal 110 both along and up out of the pit 108 is avoided thereby resulting in improved mining efficiency.

The pit 108 has no haulage access ramps 120. Advantageously, the need to create and later fill access ramps 120 is avoided thereby further increasing mining efficiency. Also, there is no need to provide an excavator 114 in the pit, and there is no need for associated equipment which would otherwise be required to build and maintain haul roads in pit for the trucks and service equipment to use, which further increases mining efficiency.

The system 200 further includes a surface excavator 204 and surface waste haulage trucks 206 for pre-stripping high wall surface waste 208 to uncover the overburden 102. Haulage bridges 209 are provided at intervals to optimize the mass haul distance of the pre-stripped waste material along the whole length of the strip mine to enable the off-highway waste haulage trucks 206 to cross the pit 108 when hauling pre-stripped waste 208.

The system 200 further includes a coal stockpile 210, deposited by and adjacent to the dragline 202 on a substantially level overburden platform 212 supporting the dragline 202. Another coal stockpile 211 may alternatively or also be deposited on the pre-stripped bench area adjacent to the dragline 202, or another coal stockpile 213 deposited on the highwall area 222 adjacent to the dragline 202 in the case where no pre-stripping operations are in existence. A loader 214 loads the stockpiles 210, 211, 213 onto comparatively highly efficient coal haulage trucks 216 from the platform/s. The coal haulage trucks 216 may be of a multi-trailer configuration with high capacity and capable of comparatively high speeds, thereby more rapidly hauling the deposited coal stockpiles 210, 211, 213 away to the processing plant some distance away from the open pit, thereby increasing the mining efficiency.

The system may further include an alternative method of transporting the coal stockpiles 210, 211, 213 to the processing plant some distance away. This may be by means of loading the coal onto a conveying system or into wagons of a local mine rail system, which transports the coal at a much higher level of efficiency to the processing plant some distance away from the open pit, thereby increasing the mining efficiency.

The system 200 further includes an overburden drill 218 for drilling when setting explosives for blasting the overburden 102. A spoil reconditioning dozer 220 works on the low wall spoil piles of the pit 108 to recondition the mining landform to a suitable landform according to the requirements set for the post mining requirements of the mine. The spoil reconditioning dozer 220 is not required to push as much material around the low wall spoils since there are no ramps required to be filled, thereby increasing the mining efficiency.

An open pit mining method using the system 200 is now briefly described.

The mining method involves pre-stripping the surface waste 208 (which may also have had to be drilled and blasted) with the excavator 204 to uncover the remaining overburden 102. The pre-stripped waste is hauled over the bridges 209 in trucks 206 crossing the pit 108 thus reducing haulage distance when compared with going around the pit 108. A series of the bridges 209 are created at intervals and the locations of the bridges 209 are entirely unaffected by pit ramps 120 which are not provided.

The mining method further involves drilling with the drill 218 when setting explosives for blasting the overburden 102 along a strip. The dragline 202 rests on the level platform 212 of blasted overburden 102. The dragline 202 lifts and removes overburden 102 from the highwall 106 of the open pit 108. The dragline 202 further removes the coal 110 in the pit 108 which is exposed when the overburden 102 is removed. Additionally (or as an alternative to the dragline 202), the mined coal 110 may also be removed from the pit 108 by a primary lifting machine unrelated to the dragline 202, such as a crawling or walking crane or a second dragline, each of which may be modified in order to operate in the mode required to perform this function.

There may be no equipment or personnel in the pit 108 when the dragline 202 removes the overburden 102 and coal 110. This enables, amongst other things, further blasting adjacent the pit 108 on the high wall 222 side either during or prior to completion of overburden 102 and coal 110 removal. Advantageously, this adjacent high wall side blasting can occur whist material is still being removed from the mine which results in significant mining efficiency gains.

Alternatively there may be the requirement for a dozer to operate in the base 116 of the open pit 108 adjacent the dragline 202 whilst it is undertaking coal removal activities, or adjacent to the other primary lifting machine in the case where a machine other than the overburden waste dragline removes the valuable material. Such dozer may be required in order to ensure that there is a clean separation of valuable material 110 from overburden waste material 102, and so that the remnants of valuable material 110 in the open pit 108 are adequately cleaned up for maximum extraction of the valuable material 110 (ie. a function commonly termed minimizing coal loss in conventional coal mining operations). The dozer may also be involved in the ripping and winning of the coal, and stockpiling the coal for loading at the base of the open pit. In such cases the dozer would access the base 116 of the pit 108 using a temporary steep low wall spoil ramp (not shown) that would be developed by the dragline and the dozer in combination. Such a low wall spoil ramp would be very steep when compared with conventional truck ramps 120, sufficient necessarily to only cater for the dozer to enter and exit the base of the pit 108 for the purpose of clean-up operations. In such cases the temporary steep low wall ramp would be filled in and redeveloped as the mining advances in the ordinary sequence of the overburden removal operations, resulting in no loss of efficiencies.

The operations may require that water that may have accumulated in the base 116 of the pit 108 needs to be removed ie. pumped out of the pit 108. Such operations may be facilitated by pumping such water over the highwall 106 & 222 using specialized highwall water pumping devices with associated pipelines to cater for the water removal, which may not involve personnel having to access the base 116 of the open pit 108. Alternatively the water may be removed by locating a water pumping device in the base of the open pit 108, which may involve personnel having to access the base 116 of the open pit 108.

The operations may further require that specialized maintenance or operational personnel may need to access the base 116 of the pit 108, in the event of machine breakdown, inspection of the valuable material and the mine workings, or associated with the water pumping devices or pipelines etc. In such instances, these personnel would be lifted and carried into and out of the pit 108 by the use of a personnel basket (with appropriate safety procedures) operating from a crane positioned on the highwall 106 & 222 side of the pit 108. If consumable materials were required to be delivered into the base 116 of the open pit 108 in order to continue with the operations (ie. such as fuel to operate the water pumping devices) these may be lifted and carried into and out of the pit 108 by a crane positioned on the highwall 222 side of the pit 108.

Figure 1:
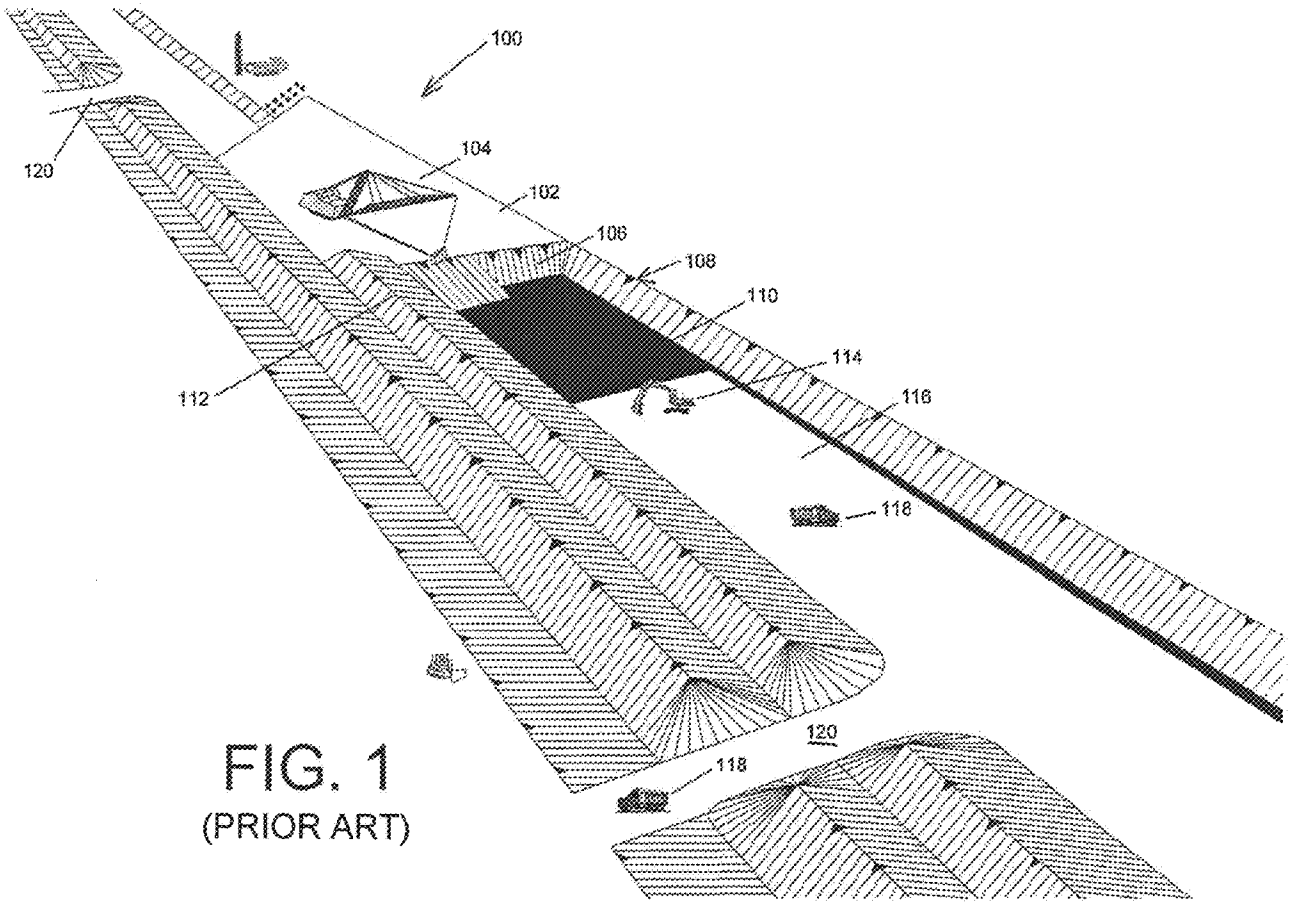
FIG. 1 (PRIOR ART)
FIG. 1 is a schematic perspective diagram showing a known open pit coal mining system.
Figure 1A:
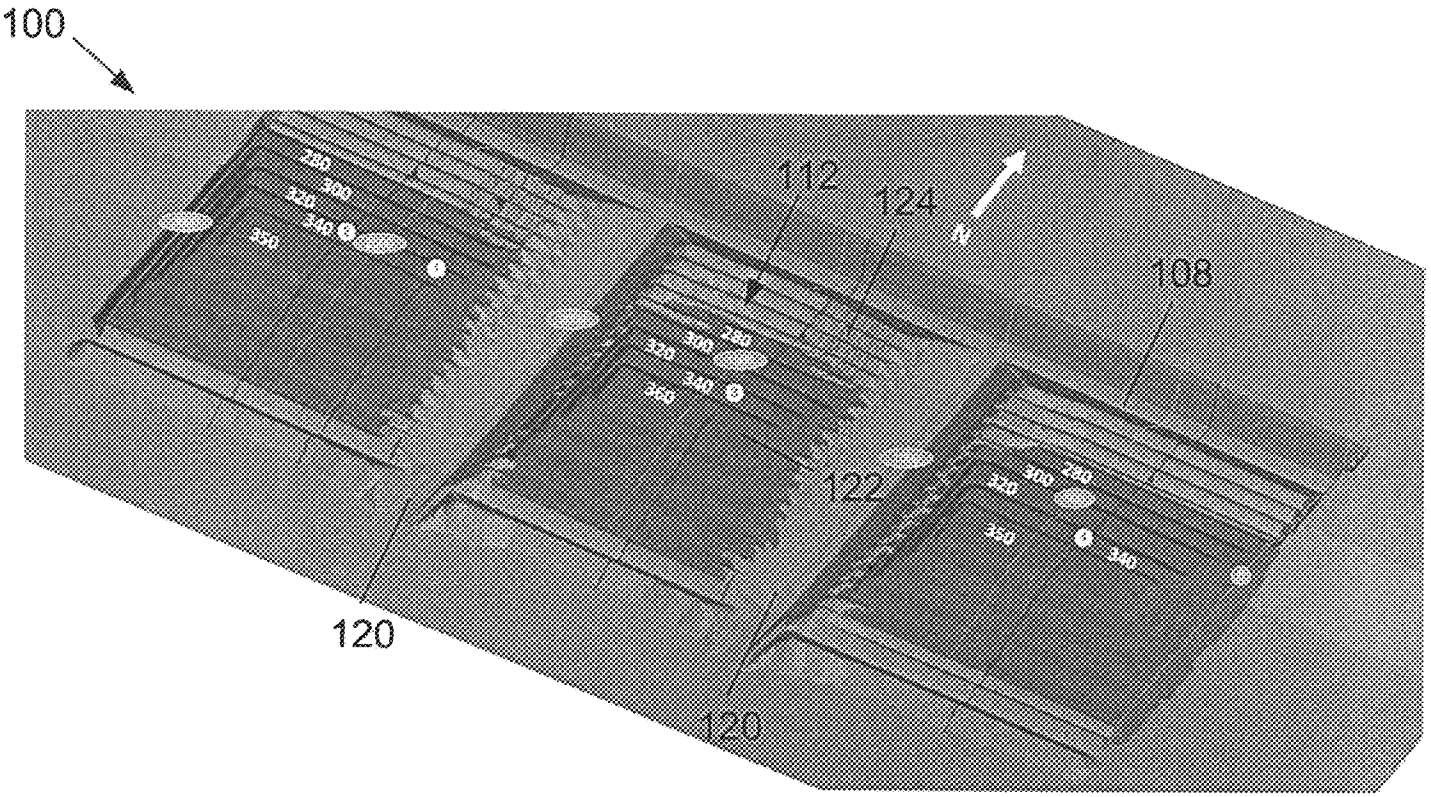
FIG. 1A (PRIOR ART)
FIG. 1A is a schematic perspective diagram of the mining system of FIG. 1, showing the low wall spoil.
Figure 1C:
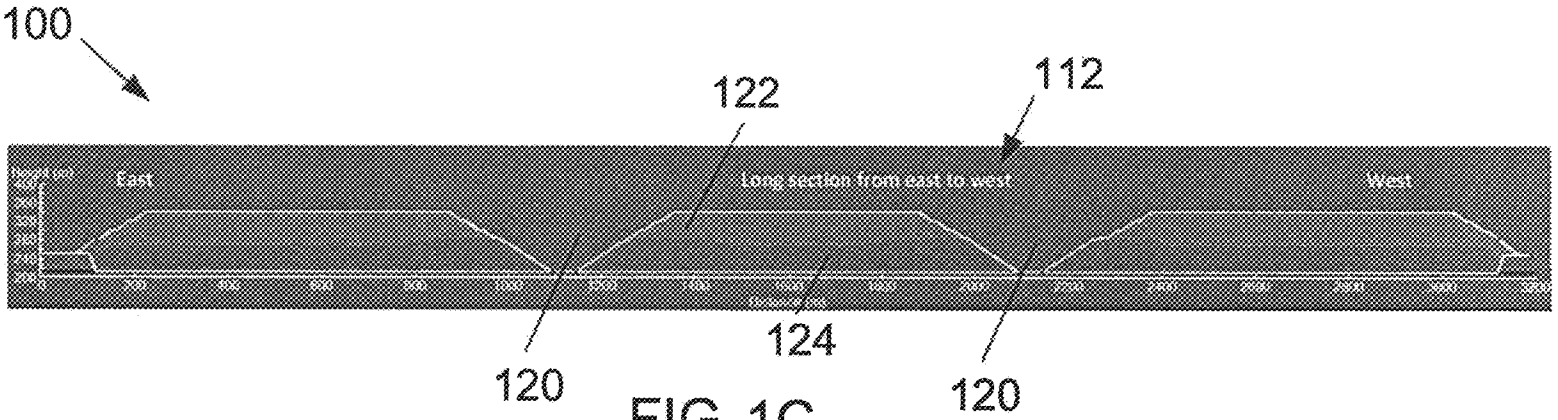
FIG. 1C (PRIOR ART)
FIG. 1C is a front sectional view of the mining system of FIG. 1A.
Figure 2A:
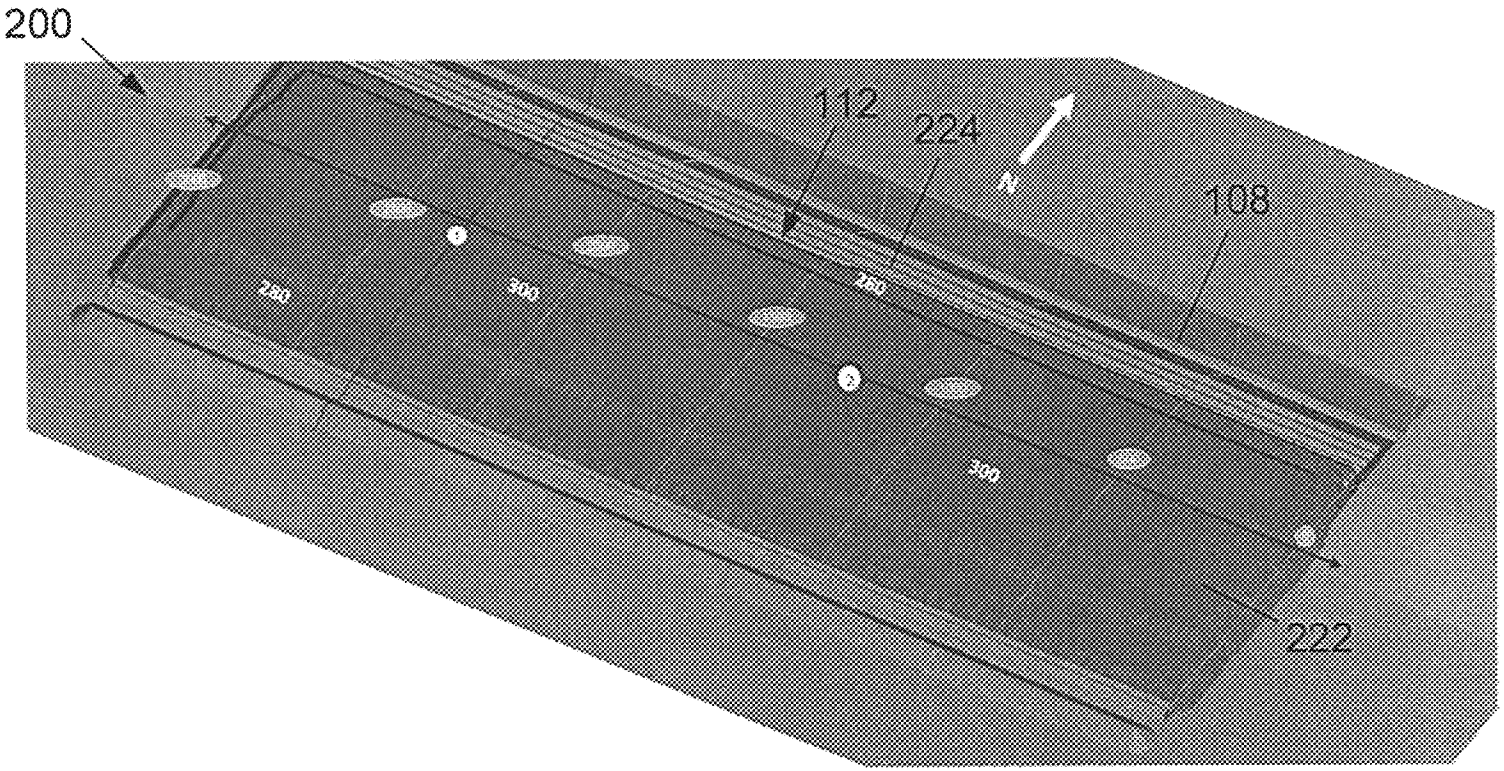
FIG. 2A is a schematic perspective diagram of the mining system of FIG. 2, showing the low wall spoil.
Figure 2B:
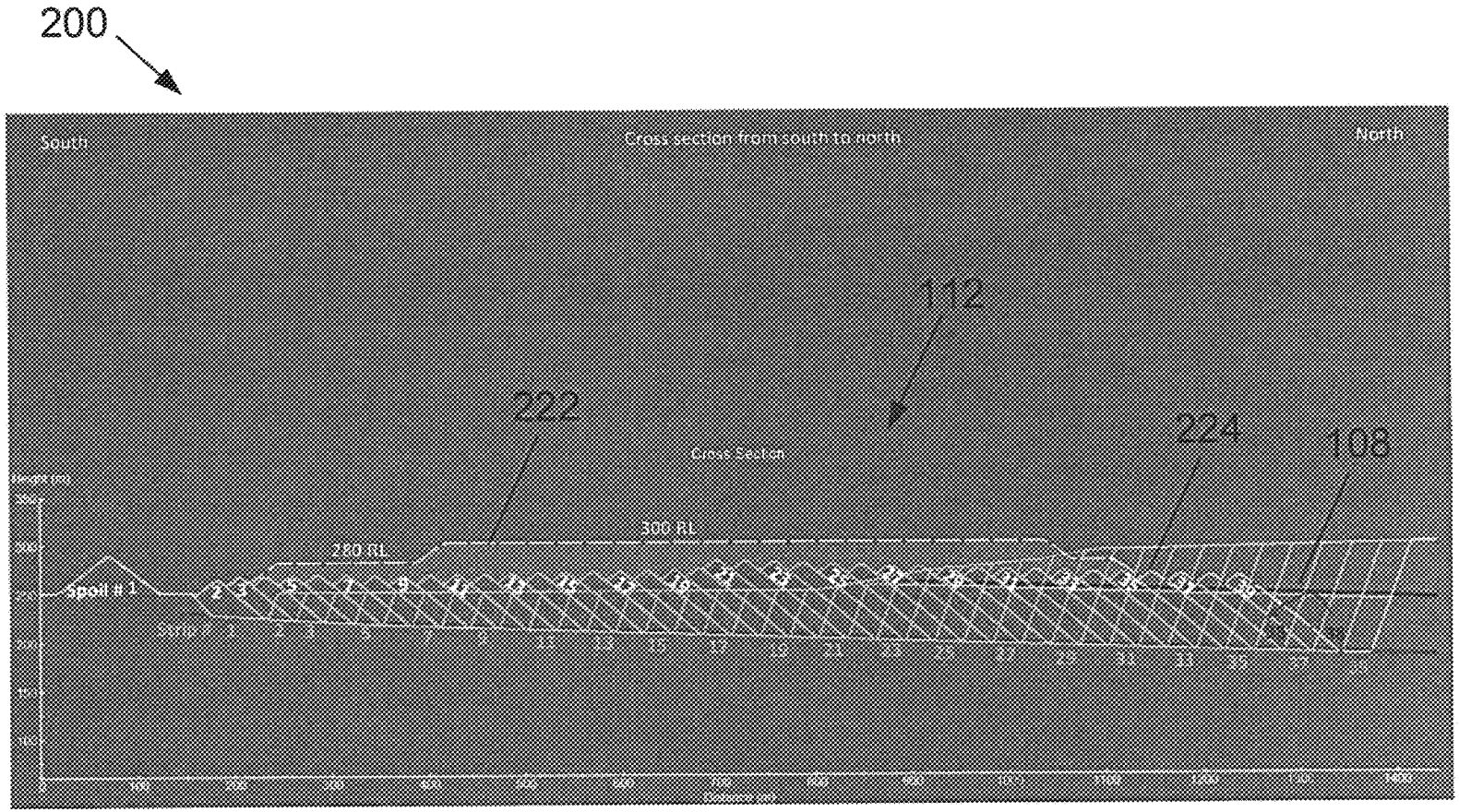
FIG. 2B is an end sectional view of the mining system of FIG. 2A.
Figure 2C:
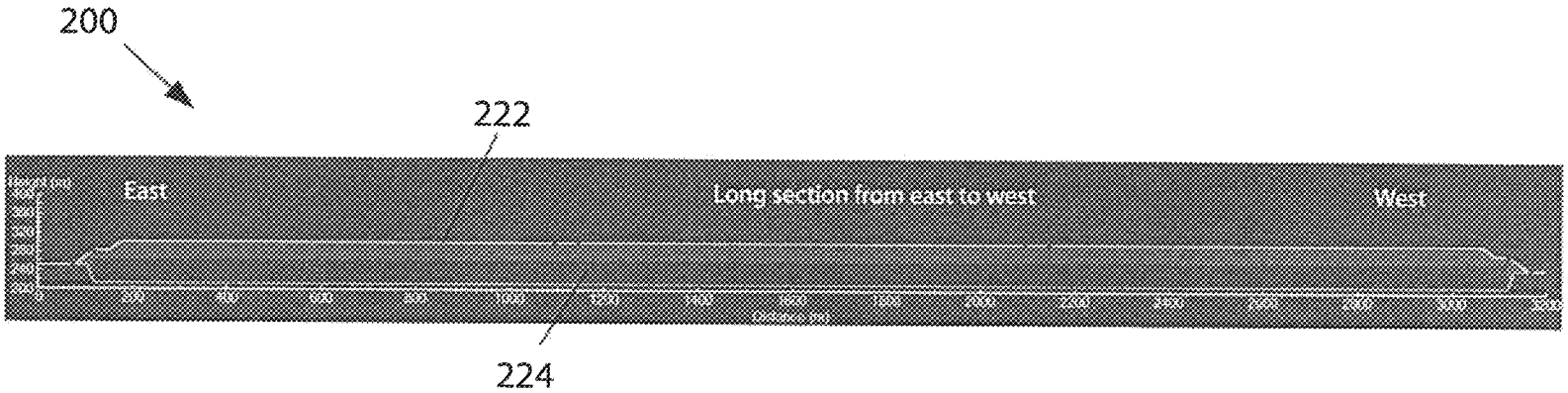
FIG. 2C is a front sectional view of the mining system of FIG. 2A.

The method does not involve forming conventional haulage access ramps 120 to the pit 108 and the lower overall mine profile is shown in FIGS. 2A to 2C, when compared with analogous FIGS. 1A to 1C of the prior art. FIGS. 2A and 2C clearly show the absence ramps with a 30 meter wide strip mine pit 108. The overall dimensions of the exampled worked mining system 100 are once again 3,000 meter length and 1,200 meter width for the sake of comparison. As can best be seen in FIG. 2B, the low wall spoil 112 includes a generally flat pre-strip volume 222 piled low upon a dragline volume 224. The spoil pile 112 adjacent the mine pit 108 defines a substantially level plateau which spans most (>half) of the length of the pit 108 (see FIG. 2C) and most of the width of the mine (see FIG. 2B). After mining ceases, the spoil reconditioning dozer 220 is not required to push as much material around the flat wall spoil 112, thereby greatly increasing the mining efficiency.

Advantageously, the need to create and later fill access ramps 120 is avoided thereby further increasing mining efficiency. The method also does not involve providing an excavator 114 located in the pit 108 to further increase efficiency.

Figure 3A:
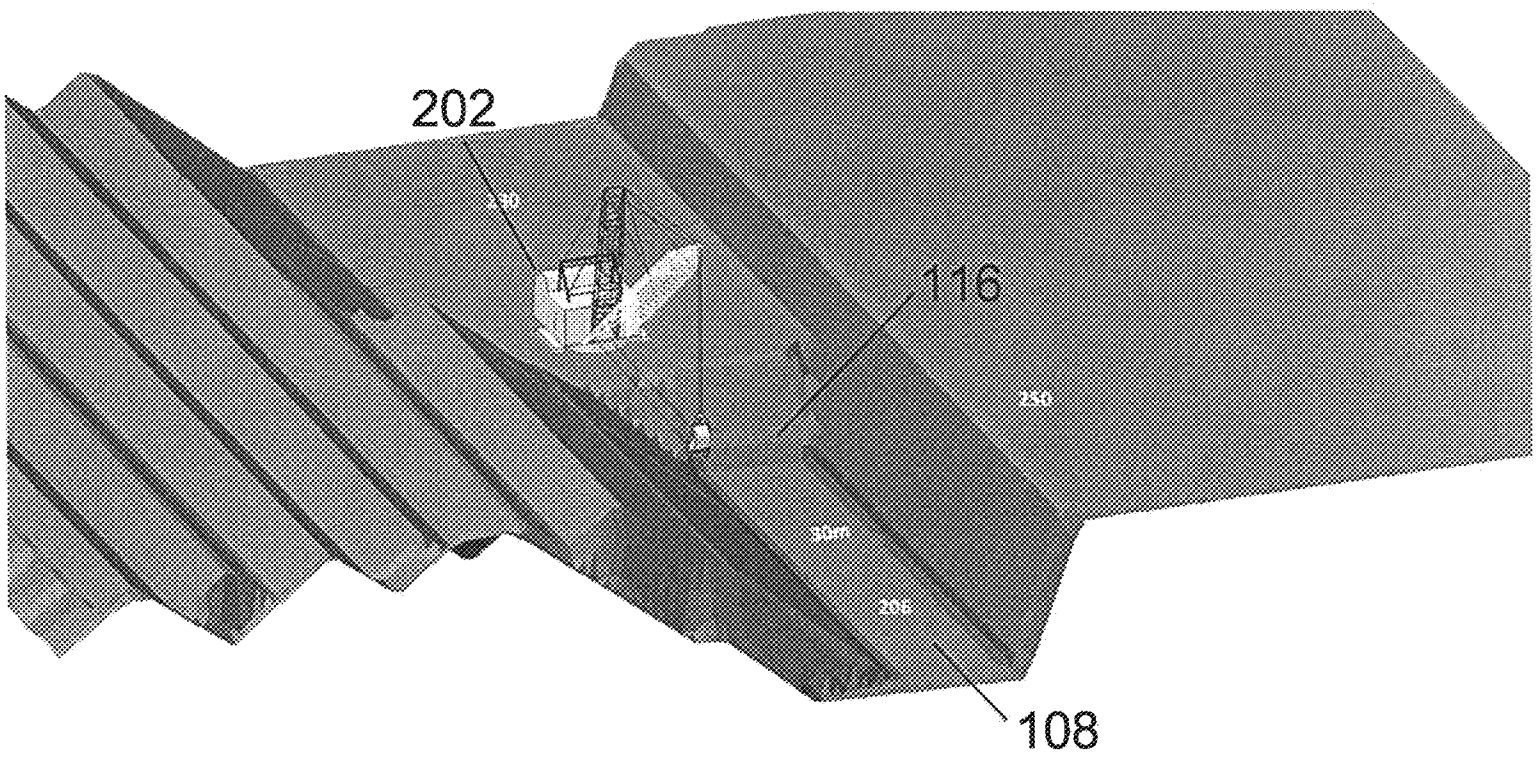
FIGS. 3A, 3B, and 3C show the sequence of a single dragline working a 30 meter wide strip mine pit of the system of FIG. 2.
Figure 3B:
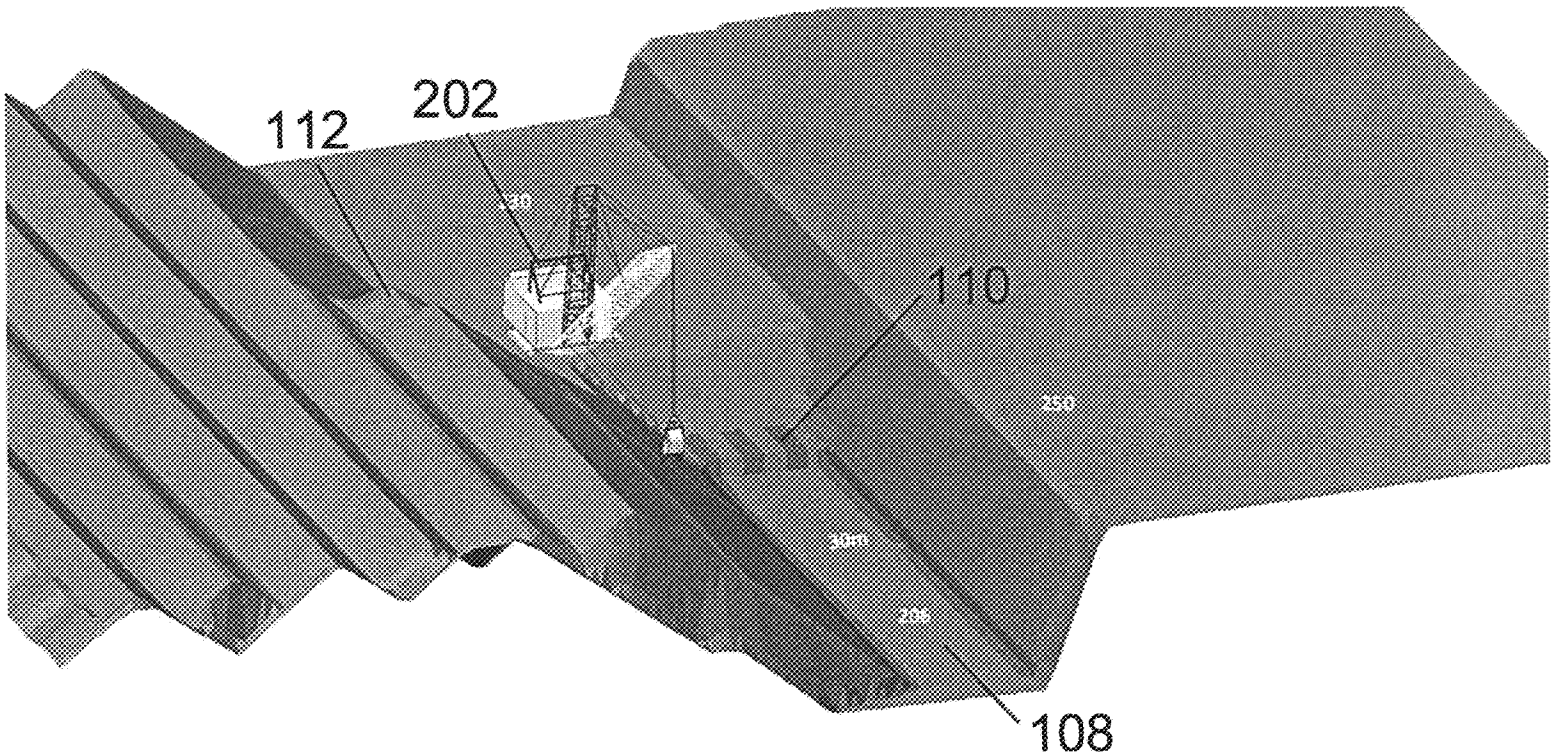
Figure 3C:
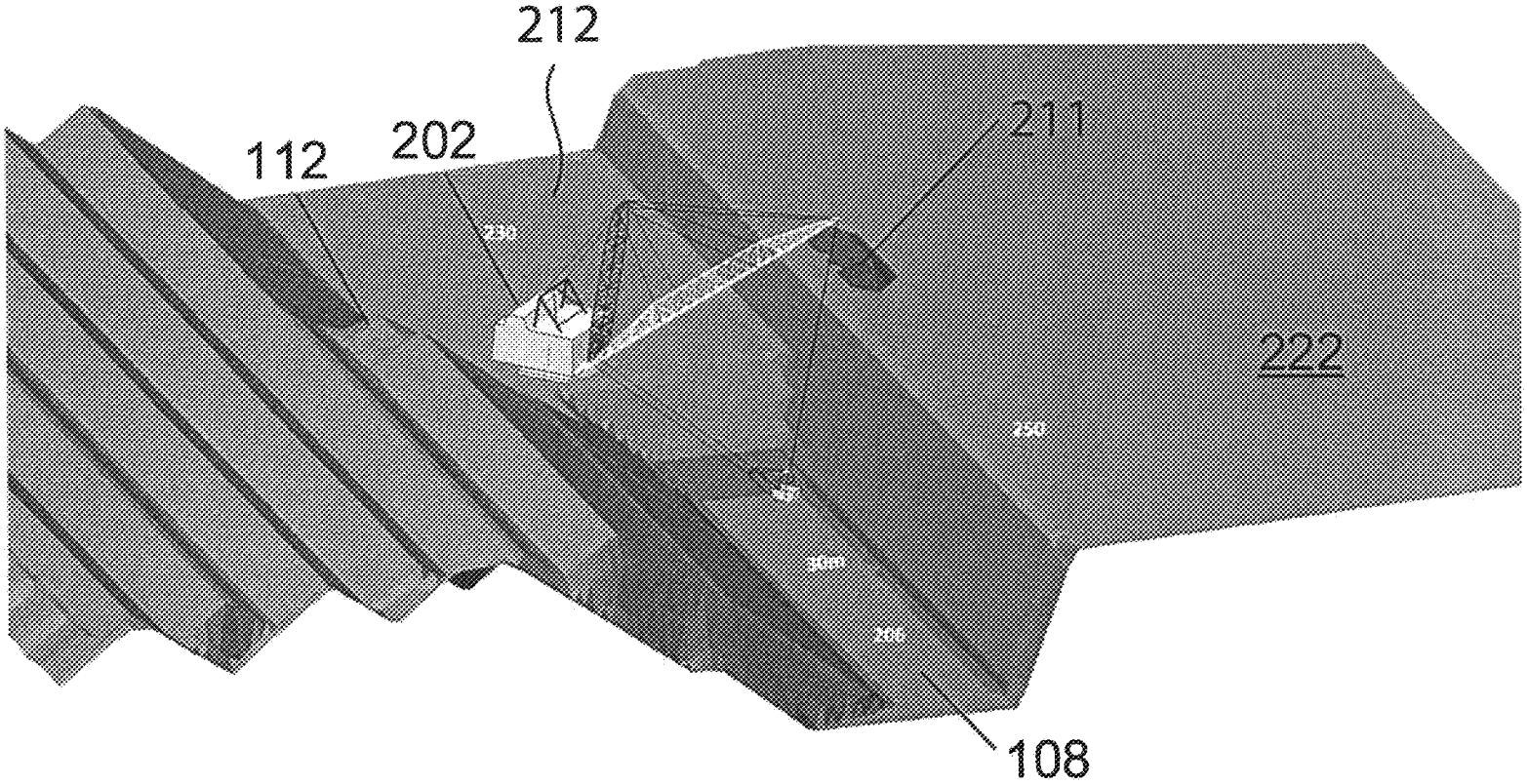

FIGS. 3A-3C show the sequence of a single dragline 202 working the 30 meter wide strip mine pit 108 of FIG. 2. The dragline 202 can be the same or smaller than conventional draglines used on 60 meter wide pits. FIG. 3*a* shows the dragline 202 configured to remove overburden from the base 116 of the open pit 108. FIG. 3*b* shows the dragline 202 adding the removed overburden to the adjacent low wall spoil 112, and exposes the coal 110 for separate excavation. Advantageously, as shown in FIG. 3*c*, the dragline 202 then removes the exposed coal seam 110 and efficiently deposits it in a stockpile 211 on the pre-stripped bench area adjacent to the dragline 202, or another coal stockpile 213 deposited on the highwall area 222 adjacent to the dragline 202 in the case where no pre-stripping operations are in existence. The dragline 202 repeats this process and moves rearwards to extend the strip mine pit 108.

The working of a 30 meter strip mine pit 108 is highly efficient, when compared with known 60+ meter strip mine pits 108 requiring larger equipment (draglines, >200 t excavators, >100 tonne rear dump and belly dump trucks). The following benefits apply for strip widths of less than 40 meters (no coal haulage ramps to pit floor) when compared with conventional 50-80 meter strip width (with coal haulage ramps 120 to pit floor 116):

i. Additional cast blast volume as percentage of total overburden waste volume, lowering overall mining cost and resulting in increased total "prime" waste removal rate, and consequent faster "coal uncovery" rate.

ii. The opportunity for improved waste fragmentation due to higher intensity blasting (with an increased powder factor in kg/cubic meter), resulting in faster dragline bucket fill times and consequent improved dragline productivity.

iii. Reduced dragline spoil height (compare FIG. 2B with FIG. 1B) due to tighter spoil peaks, resulting in reduced hoist time, improved dragline excavation productivity and/or a higher dragline operating level within the pit 108. This also allows prestrip volumes to be reduced with significant cost savings.

iv. Reduced dragline waste rehandle percentage by carefully matching site geology (depth, seam dip etc) to dragline operating parameters and strip geometry, resulting in increased total "prime" waste removal rate, and consequent faster "coal uncovery" rate.

v. Reduced dragline average bucket swing angles and average hoist distances in conjunction with reduced dragline "positioning time on bench" by carefully matching site geology (depth, seam dip etc) to preferred dragline operating parameters and strip geometry, resulting in increased dragline productivity and increased total "prime" waste removal rate, and consequent faster "coal uncovery" rate.

vi. Reduced amounts of inventory of waste removal activities in advance of the current mining area in pit (relating to drilling, blasting, prestripping, and dragline volumes) that are considered as work-in-progress to deliver each tonne of mined coal, resulting in lower cash outlays and improved financial returns.

vii. Shorter cross-pit prestrip bridges 209 which result in reduced volumes to be managed by the dragline 202 in order to develop and manage the cross-pit bridges 209. This also allows for higher elevations of the cross-pit bridges so that prestrip truck haul costs can be improved/optimised.

viii. The reduced dragline spoil height also results in a reduced height for the hauling and dumping of the prestrip waste material to its final position, which results in further significant cost savings.

ix. Improved dragline safety management, as blast profiles can be essentially flat allowing the dragline 202 to work anywhere on that surface level. The operating bench will be buttressed against the highwall 222 and no unsupported elevated low-wall benches are required.

Figure 4A:
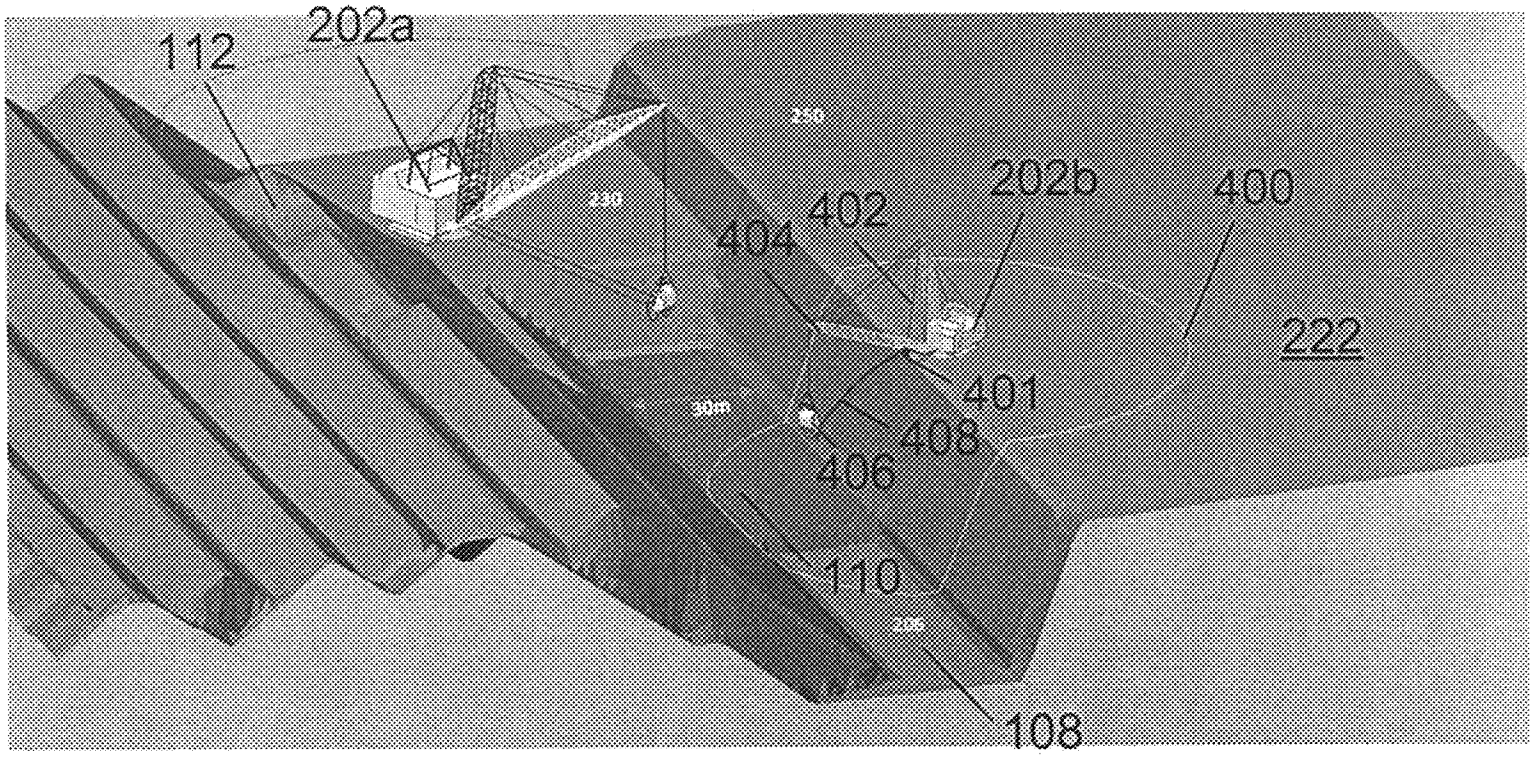
FIGS. 4A and 4B show a dual dragline system for working a 30 meter wide strip mine pit of the system of FIG. 2, and bucket line arrangements to avoid interference with the edge of the high wall.
Figure 4B:
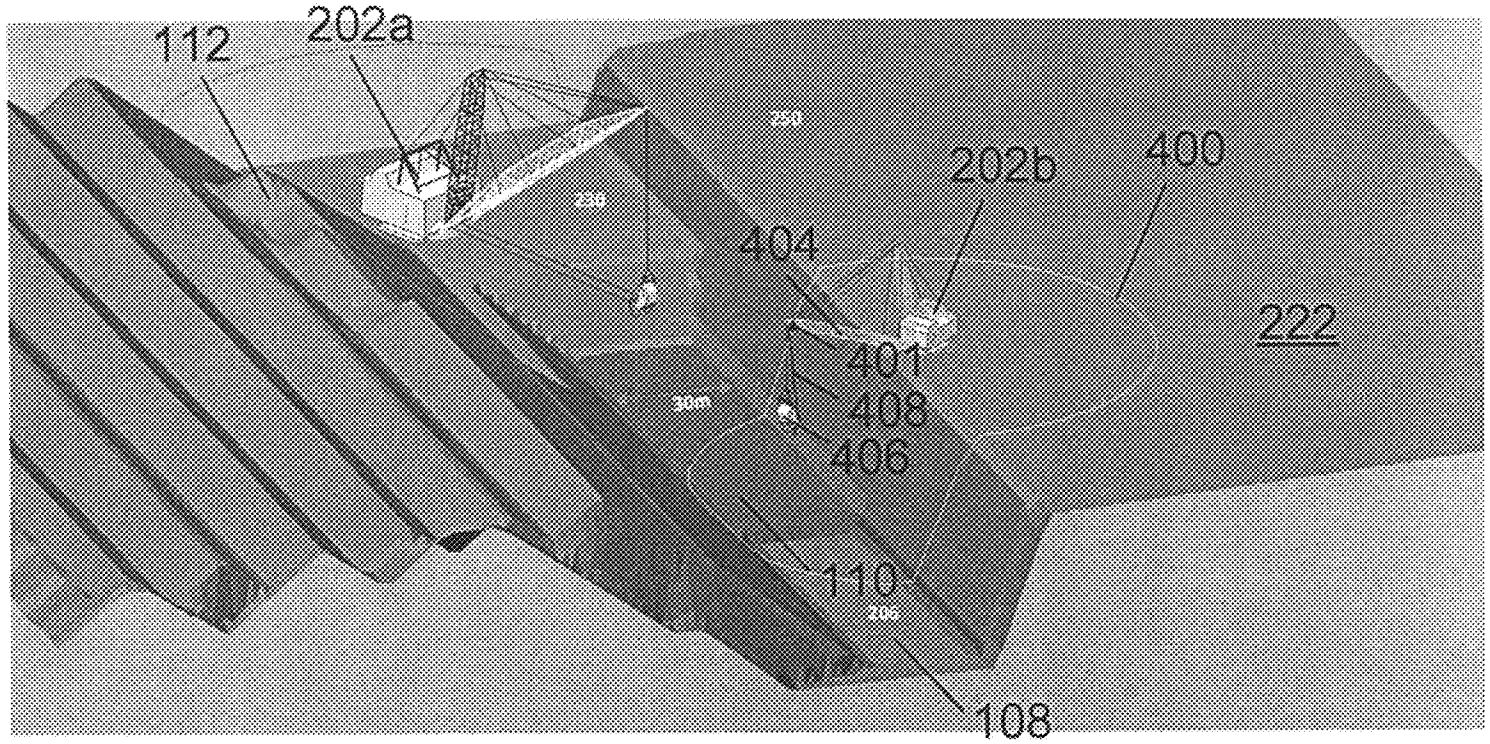

FIGS. 4A-B show a dual dragline system with minimal radial movement and for working a 30 meter wide strip mine pit 108 of the system of FIG. 2. An overburden (i.e. first) dragline 202*a*, resting on an in pit bench or shelf and at the end of the mine pit 108, removes overburden from the base 116 of the open pit 108 and adds the removed overburden to the adjacent low wall spoil 112 formed on the shelf. Simultaneously, a coal (i.e. second) dragline 202*b*, operating at the side of the pit 108, removes the exposed coal seam 110, and places it on the pre-stripped bench area or highwall area 222 upon which the dragline 202*b* itself rests. The coal dragline 202*b* need not be as large as the overburden dragline 202*a* and has a reduced working reach area 400.

The coal dragline 202*b* can include a modified rigging and dumping arrangement, to reduce line interference with the highwall pit edge, when compared with a conventional dragline. Turning to FIG. 4A, the dragline 202*b* can have a pulley mechanism 401 located some distance along the boom 404 from the base of the fairleads 402 which provides enough clearance so that the bucket control line 408 does not interfere with the edge of the high wall 222. Alternatively, the bucket control line 408 can extend downward from the end of the boom to control the bucket 406 as shown in FIG. 4B, thereby also avoiding the dragging of the line 408 on the high wall 222 when the coal 110 is being mined or hoisted from the pit 108 in the bucket 408.

A person skilled in the art will appreciate that many embodiments and variations can be made without departing from the ambit of the present invention.

In one embodiment, dragline 202 can be replaced with a crawler, walking crane or any other like primary lifting type machine/device. Such machines may also be specially configured in order to perform this function.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims appropriately interpreted by those skilled in the art.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The claims defining the invention are as follows:

1. An open pit mining system, the system including:
   - a pre-stripped bench formed by pre-stripping waste adjacent a highwall;
   - a material lifting machine configured to excavate and remove overburden from an open pit of a mine, the material lifting machine further configured to excavate and remove coal from the open pit; and
   - one or more haulage bridges that bridge the open pit, the haulage bridges configured to support a truck loaded with the pre-stripped waste.

2. A mining system as claimed in claim 1, wherein the open pit has no coal haulage ramps.

3. A mining system as claimed in claim 1, wherein the material lifting machine includes a dragline, crawler, or walking crane configured to lift the overburden separately from the coal.

4. A mining system as claimed in claim 1, wherein the open pit is a strip mine pit with an overburden spoil pile formed adjacent the strip mine pit, the spoil pile formed by the material lifting machine and defining a plateau.

5. A mining system as claimed in claim 1, further including excavation and haulage equipment for pre-stripping the waste from the overburden.

6. A mining system as claimed in claim 1, further including a deposited stockpile of removed coal at about the elevation of the material lifting machine.

7. The mining system as claimed in claim 6, further including a haulage truck for hauling removed and deposited coal.

8. A mining system as claimed in claim 1, further including overburden drilling equipment to drill when preparing for blasting the overburden and/or pre-stripped waste.

9. A mining system as claimed in claim 1, further including a spoil reconditioning excavator or dozer for reconditioning land on a low wall side of the open pit.

10. An open pit mining method using one or more material lifting machines, the method including the steps of:
   - pre-stripping waste adjacent a high wall to reveal overburden;
   - the one or more lifting machines:
     - excavating and removing the overburden from an open pit of a mine; and
     - excavating and removing coal from the open pit; and
   - hauling the waste with trucks over one or more overburden bridges crossing the open pit.

11. An open pit mining method as claimed in claim 10, wherein the one or more material lifting machines include a single lifting machine which removes the overburden and also removes the coal.

12. An open pit mining method as claimed in claim 10, wherein the one or more material lifting machines include a first lifting machine removes the overburden whereas a second lifting machine removes the coal.

13. An open pit mining method as claimed in claim 10, not involving forming haulage access ramps to the open pit.

14. An open pit mining method as claimed in claim 10, wherein the open pit is a strip mine pit and the method involves forming an overburden spoil pile adjacent the strip mine pit, the spoil pile formed by the material lifting machine and defining a plateau.

15. An open pit mining method as claimed in claim 10, involving depositing the removed coal at the elevation of the one or more material lifting machines.

16. An open pit mining method as claimed in claim 10, involving hauling away deposited coal in hauling trucks.

17. An open pit mining method as claimed in claim 10, further involving creating a series of the bridges over the open pit.

18. An open pit mining method as claimed in claim 10, wherein the method further involves blasting the overburden adjacent the open pit either during or prior to completion of steps of removing the overburden from the open pit.

* * * * *